US010700408B2

(12) United States Patent
Werner et al.

(10) Patent No.: US 10,700,408 B2
(45) Date of Patent: Jun. 30, 2020

(54) PANE WITH ELECTRICAL CONNECTION ELEMENT AND CONNECTING ELEMENT ATTACHED THERETO

(71) Applicant: SAINT-GOBAIN GLASS FRANCE, Courbevoie (FR)

(72) Inventors: Katja Werner, Simmerath (DE); Mitja Rateiczak, Wurselen (DE); Bernhard Reul, Herzogenrath (DE); Klaus Schmalbuch, Aachen (DE)

(73) Assignee: SAINT-GOBAIN GLASS FRANCE, Courbevoie (FR)

( * ) Notice: Subject to any disclaimer, the term of this patent is extended or adjusted under 35 U.S.C. 154(b) by 437 days.

(21) Appl. No.: 15/562,891

(22) PCT Filed: May 1, 2016

(86) PCT No.: PCT/EP2016/059716
§ 371 (c)(1),
(2) Date: Sep. 28, 2017

(87) PCT Pub. No.: WO2016/177653
PCT Pub. Date: Nov. 10, 2016

(65) Prior Publication Data

US 2018/0083339 A1 Mar. 22, 2018

(30) Foreign Application Priority Data

May 5, 2015 (EP) ..... 15166354

(51) Int. Cl.
*H01Q 1/12* (2006.01)
*H01Q 1/32* (2006.01)
(Continued)

(52) U.S. Cl.
CPC ..... *H01Q 1/1278* (2013.01); *H01Q 1/02* (2013.01); *H01Q 1/3275* (2013.01);
(Continued)

(58) Field of Classification Search
CPC ..... H01Q 1/3275; H01Q 1/3283; H01Q 1/02; H01Q 1/1278; H01Q 1/1271; H01R 4/023; H05B 3/84; H05B 2203/016
See application file for complete search history.

(56) References Cited

U.S. PATENT DOCUMENTS 2,644,066 A 6/1953 Glynn
4,454,378 A 6/1984 Neuroth
(Continued)

FOREIGN PATENT DOCUMENTS

DE 3344091 A1 6/1984
DE 9013380 U1 11/1990
(Continued)

OTHER PUBLICATIONS

International Search Report for PCT/EP2016/059716 filed on behalf of Saint-Gobain Glass France. dated Jul. 22, 2016. 6 pages (English Translation + German Original).
(Continued)

*Primary Examiner* — Graham P Smith
*Assistant Examiner* — Jae K Kim
(74) *Attorney, Agent, or Firm* — Pillsbury Winthrop Shaw Pittman LLP

(57) ABSTRACT

The described methods and devices disclose panes with an electrical connection element for motor vehicles with electrically conductive structures such as heating conductors or antenna conductors. The electrically conductive structures may be connected to the vehicle's electrical system via connecting elements. The connecting elements can be flexible connection cables that may be outfitted with a standardized plug connector. According to the disclosed teachings, the process of installing such panes within the vehicle body is simple and time-saving.

26 Claims, 4 Drawing Sheets

Figure 1:
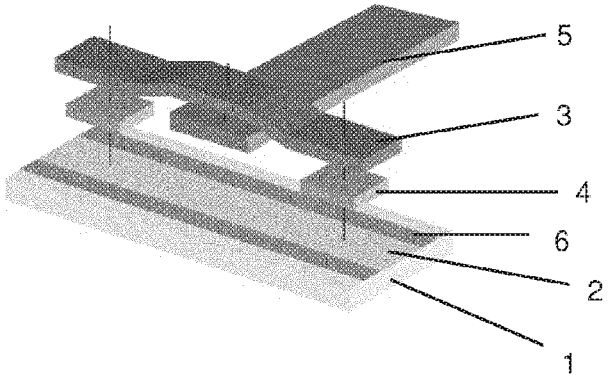

(51) Int. Cl.
*H01Q 1/02* (2006.01)
*H05B 3/84* (2006.01)
*H01R 4/02* (2006.01)

(52) U.S. Cl.
CPC ..... *H01Q 1/3283* (2013.01); *H01R 4/023* (2013.01); *H05B 3/84* (2013.01); *H01Q 1/1271* (2013.01); *H05B 2203/016* (2013.01)

(56) References Cited

U.S. PATENT DOCUMENTS

| | | | | | |
|---|---|---|---|---|---|
| 5,738,529 | A * | 4/1998 | Wedell | H01Q 21/00 | 343/906 |
| 5,738,534 | A * | 4/1998 | Ingles | H01R 24/52 | 439/83 |
| 5,738,554 | A | 4/1998 | Borger et al. | | |
| 6,027,356 | A * | 2/2000 | Wright | H01R 11/22 | 439/268 |
| 6,262,513 | B1 * | 7/2001 | Furukawa | H01L 21/56 | 257/E21.502 |
| 9,635,758 | B2 | 4/2017 | Schmalbuch et al. | | |
| 9,967,967 | B2 | 5/2018 | Schmalbuch et al. | | |
| 10,374,343 | B2 | 8/2019 | Schmalbuch et al. | | |
| 2003/0042239 | A1 * | 3/2003 | Sol | B32B 17/10036 | 219/203 |
| 2004/0048524 | A1 | 3/2004 | Yuasa et al. | | |
| 2005/0112291 | A1 | 5/2005 | Okajima et al. | | |
| 2005/0221657 | A1 * | 10/2005 | Hisaeda | H01R 13/20 | 439/367 |
| 2006/0240265 | A1 * | 10/2006 | Cook | B23K 35/262 | 428/426 |
| 2007/0224842 | A1 | 9/2007 | Hoepfner et al. | | |
| 2010/0285685 | A1 * | 11/2010 | Ziegler | H05B 3/84 | 439/382 |
| 2010/0294566 | A1 * | 11/2010 | Reul | B32B 17/10036 | 174/94 R |
| 2012/0067641 | A1 | 3/2012 | Tokiwa et al. | | |
| 2014/0182932 | A1 | 7/2014 | Cholewa et al. | | |
| 2015/0264800 | A1 | 9/2015 | Schmalbuch et al. | | |
| 2015/0296615 | A1 | 10/2015 | Schmalbuch et al. | | |
| 2016/0240935 | A1 | 8/2016 | Katakura | | |
| 2016/0270159 | A1 * | 9/2016 | Rateiczak | H05B 3/20 | |
| 2017/0033481 | A1 * | 2/2017 | Schmalbuch | H01R 4/06 | |
| 2017/0368642 | A1 * | 12/2017 | Pereira | H05K 3/3463 | |
| 2018/0330845 | A1 | 11/2018 | Reul et al. | | |

FOREIGN PATENT DOCUMENTS

| | | | | | |
|---|---|---|---|---|---|
| DE | 4439645 | C1 | | 4/1996 | |
| DE | 10338297 | A1 | | 6/2004 | |
| DE | 202013006781 | U1 | | 8/2013 | |
| DE | 202013006775 | U1 | | 9/2013 | |
| EP | 0477069 | A2 | | 3/1992 | |
| EP | 1488972 | A1 | | 12/2004 | |
| EP | 2361450 | A1 | | 8/2011 | |
| JP | S565394 | U | | 1/1981 | |
| JP | H06290855 | A | | 10/1994 | |
| JP | 2004189023 | A | * | 7/2004 | H05B 3/84 |
| JP | 2004189023 | A | | 7/2004 | |
| JP | 2010539661 | A | | 12/2010 | |
| JP | 2015069893 | A | | 4/2015 | |
| KR | 20090122535 | A | | 12/2009 | |
| KR | 101077081 | B1 | | 10/2011 | |
| WO | 2008/137946 | A1 | | 11/2008 | |
| WO | 2010/057641 | A1 | | 5/2010 | |
| WO | 2012/152543 | A1 | | 11/2012 | |
| WO | 2014/079594 | A1 | | 5/2014 | |

OTHER PUBLICATIONS

Final Office Action for U.S. Appl. No. 15,1303,729, filed Oct. 12, 2016 on behalf of Saint-Gobain Glass France. dated Aug. 23, 2018. 21 pages.

International Search Report for International Application No. PCT/EP2015/055007 filed Mar. 11, 2015 on behalf of Saint-Gobain Glass France. dated Jun. 8, 2015. 5 pages (English Translation + German Original).

International Search Report for international Application No. PCT/EP2015/076186 filed Nov. 10, 2015 on behalf of Saint-Gobain Glass France. dated Feb. 5, 2016. 4 pages (English Translation + German Original).

Non-Final Office Action for U.S. Appl. No. 15/303,729, filed Oct. 12, 2016 on behalf of Saint-Gobain Glass France. dated Apr. 5, 2018. 18 pages.

Non-Final Office Action for U.S. Appl. No. 15/529,071, filed May 23, 2017, on behalf of Saint-Gobain Glass France. dated Dec. 10, 2018. 18 pages.

Notice of Allowance for U.S. Appl. No. 15/303,729, filed Oct. 12, 2016 on behalf of Saint-Gobain Glass France. dated Apr. 1, 2019. 11 pages.

Notice of Allowance for U.S. Appl. No. 15/303,729, filed Oct. 12, 2016, on behalf of Saint-Gobain Glass France. dated Dec. 4, 2018. 9 pages.

Restriction Requirement for U.S. Appl. No. 15/529,071, filed May 23, 2017, on behalf of Saint-Gobain Glass France. dated Sep. 18, 2018. 5 pgs.

Written Opinion for International Application No. PCT/EP2015/055007 filed Mar. 11, 2015 on behalf of Saint-Gobain Glass France. dated Jun. 8, 2015. 15 pages (English Translation + German Original).

Written Opinion for International Application No. PCT/EP2015/076186 filed Nov. 10, 2015 on behalf of Saint-Gobain Glass France. dated Feb. 5, 2016. 11 pages (English Translation + German Original).

Written Opinion for International Application No. PCT/EP2016/059716 filed May 1, 2016 on behalf of Saint-Gobain Glass France, dated Jul. 22, 2016. 15 pages (English Translation + German Original).

* cited by examiner

PANE WITH ELECTRICAL CONNECTION ELEMENT AND CONNECTING ELEMENT ATTACHED THERETO

CROSS REFERENCE TO RELATED APPLICATIONS

The present application is the U.S. national stage of International Patent Application PCT/EP2016/059716 filed internationally on May 1, 2016, which, in turn, claims priority to European Patent Application No. 15166354.9 filed on May 5, 2015.

The invention relates to a pane with an electrical connection element and a connecting element attached thereto, a method for production thereof, and use thereof.

The invention relates in particular to a pane with an electrical connection element for motor vehicles with electrically conductive structures such as heating conductors or antenna conductors. The electrically conductive structures are customarily provided with soldered-on electrical connection elements that are connected to the vehicle's electrical system via connecting elements. The connecting elements can be flexible connection cables that are directly attached to the connection element, usually welded to the connection element. Typically, the connecting cables are outfitted with a standardized plug connector. The panes can be produced prefabricated with the connection elements along with the connecting element. At the time of installation in the vehicle body, the connecting elements can then be connected to the vehicle's electrical system very simply and time-savingly with the electrical cables, in particular by means of a plug connection.

Such a pane is known, for example, from EP 0 477 069 B1, DE 4439645 C1, or DE 9013380 U1, wherein the flexible connecting cable is implemented as a customary copper flat-weave ribbon. However, the connecting element can also be implemented as a stiff part, preferably with an insertion blade, as is known, for example, from EP 1 488 972 A1.

Due to different coefficients of thermal expansion of the materials used, mechanical stresses occur during production and operation that strain the panes and can cause breakage of the panes.

Customary connection elements are made of copper, due to the good electrical conductivity. Since the coefficients of thermal expansion of copper and glass are, however, very different, mechanical stresses occur in particular during soldering as a result of the heating and cooling, which can damage the pane or the solder connection. Conventional lead-containing solders have high ductility that can compensate the mechanical stresses occurring between an electrical connection element and the pane by plastic deformation. However, because of the End of Life Vehicles Directive 2000/53/EC, lead-containing solders must be replaced by lead-free solders within the EC. The Directive is referred to, in short, by the acronym ELV (End of Life Vehicles). Its objective is, as a result of the massive increase in disposable electronics, to ban extremely problematic components from the products. The substances affected are lead, mercury, and cadmium.

Lead-free solders typically have significantly lower ductility and are, consequently, incapable of compensating mechanical stresses to the same extent as lead-containing solders. The effort must, consequently, be made, in particular in the case of solders with lead-free soldering compounds to prevent mechanical stresses, something which is, for example, possible by means of a suitable selection of the material of the connection element. If the difference in the coefficients of thermal expansion of the substrate, customarily soda lime glass, and the connection element is small, only slight mechanical stresses occur.

In WO 2012/152543 A1, for example, chromium-containing (or stainless) steels have been proposed as a particularly suitable material, which, moreover, are advantageous economically. It is, however, desirable to continue to produce the connecting element attached to the connection element from a material with higher conductivity, in particular, copper.

WO 2014/079594 A1 proposes combining a connection element with a solid connecting element. The material of the connection element for contacting the pane can then be selected primarily in view of a suitable coefficient of thermal expansion. The material of the connecting element for contacting the connection cable can, on the contrary, be selected in view of other criteria, such as optimum electrical conductivity or good formability.

The connecting element, whether it is implemented as a flexible connection cable or as a solid, bending-resistant element, is typically welded to the connection element, with the connecting element arranged on the top of the connection element facing away from the pane, as is clear from the prior art mentioned. However, this arrangement has proved problematic in terms of mechanical stresses, as occur in particular at the time of making the plug connection of the cable on the connecting element. Tensile, leverage, and shear forces greatly stress the welded connection, a situation which can lead to damage or even breakage. The connection is particularly vulnerable when different materials that cannot be welded ideally because of a different melting temperature are used for the connection element and the connecting element.

Prior publications JP 2004189023 A and JP 2015069893 A present in each case an arrangement in which a connecting element is attached to the surface of a connection element facing a substrate. In JP 2004189023 A, the connecting element is inserted into a receptacle of the connection element. In JP 2015069893 A, a connection between the connecting element and the connection element is made by crimping or soldering.

The object of the present invention is, consequently, to provide an improved pane with an electrical connection element and a connecting element attached thereto, wherein the connection between the connection element and the connecting element can withstand higher loads.

The object of the present invention is accomplished according to the invention by a pane with an electrical connection element in accordance with independent claim 1. Preferred embodiments are evident from the subclaims.

The pane according to the invention with at least one electrical connection element comprises at least:

- a substrate,
- an electrically conductive structure on a region of the substrate,
- a bridge-shaped electrical connection element, comprising a bridge region and at least two soldering feet, which are connected to a region of the electrically conductive structure via a soldering compound, and
- an electrical connecting element attached to the connection element.

The connection element according to the invention is implemented in the shape of a bridge. Such a connection element comprises a bridge region and at least two soldering feet. The soldering feet have contact surfaces that are in contact with the conductive structure via the soldering compound. The bridge region is typically but not necessarily implemented flat and aligned substantially parallel to the substrate surface. The bridge region has no direct contact with the substrate, but is, instead, arranged above the substrate such that a hollow space is created between the bridge region and the substrate surface. The soldering feet extend starting from two opposing sides of the bridge in the direction of the substrate surface and typically have, on their end, sections that are arranged flat and substantially parallel to the substrate surface. The surfaces of these sections facing the substrate form the contact surfaces (or soldering surfaces), which contact the electrically conductive structure on the substrate via the soldering compound.

Advantageously, the connecting element is implemented elongated and has a direction of extension that is not parallel to a direction of extension of the connection element. The direction of extension of the connection element is defined by a shortest (imaginary) connection between the two soldering feet. Particularly advantageously, the direction of extension of the connecting element is aligned (substantially) perpendicular to the direction of extension of the connection element.

The connecting element is provided for making electrical contact, in particular by means of an electrical cable. This cable connects the electrically conductive structure on the substrate to an external functional element, for example, a power supply or a receiver. For this, the cable is routed away from the pane starting from the connection element preferably over the side edges of the pane. The cable can, in principle, be any connection cable that is known to the person skilled in the art for the electrical contacting of an electrically conductive structure, for example, a flat conductor, a stranded wire conductor, or a solid wire conductor. The connection between the connecting element and the cable can be done in any manner familiar to the person skilled in the art, for example, by soldering, welding, screwing, via an electrically conductive adhesive, or as a plug connection.

Typically, tensile forces occurring have an upward component, i.e., directed away from the substrate. If the connecting element is arranged in the conventional manner on the surface of the bridge region facing away from the substrate, these tensile forces act directly on the connection between the connecting element and the connection element. This can easily result in breakage of the connection (in particular, a so-called "peeling" of the connecting element), particularly when the connection is weakened, as occurs, for example, in the case of a welded connection of different materials. The inventive idea consists in having the tensile forces act not on the surface facing away from the substrate but rather on the surface of the bridge region facing the substrate. The inventors realised that the tensile forces necessary for breakage are thus significantly increased. The arrangement according to the invention can, consequently, withstand higher forces and is significantly more stable than the prior art arrangement.

The invention can be realised in two different ways:

In a first embodiment, the connecting element is attached to the surface of the bridge region facing the substrate.

In a second embodiment, the connecting element is attached to the surface of the bridge region facing away from substrate and routed around the bridge region such that it rests against the surface of the bridge region facing the substrate. The connecting element runs from the surface facing away from the substrate around a side edge of the bridge region and along the surface of the bridge region facing the substrate. Preferably, the connecting element rests (with its full surface) against the entire surface facing the substrate. Thus, optimum stability is obtained. However, in principle, it suffices for the connecting element to rest against only a part of the surface, for example, against that edge that is opposite the side edge around which the connecting element is routed.

A combination of the two embodiment is also possible, wherein the connecting element is attached to the surface of the bridge region facing away from the substrate, is routed around the bridge region, and rests not only against the surface facing the substrate but is also fixedly connected, for example, is welded to this surface. Thus, an even further increased stability of the connection can be obtained. However, this makes production significantly more complex.

In a preferred embodiment, the connecting element of the pane according to the invention is connected to an electrical connection cable, in particular via the end of the connecting element opposite the connection element.

The soldering compound is lead-free in a preferred embodiment. This is particularly advantageous in terms of the environmental impact of the pane with an electrical connection element according to the invention. In the context of the invention, "lead-free soldering compound" means a soldering compound which, in accordance with the EC Directive "2002/95/EC on the Restriction of the Use of Certain Hazardous Substances in Electrical and Electronic Equipment", has a lead content less than or equal to 0.1 wt.-%, preferably contains no lead.

With lead-free soldering compounds, it is particularly advantageous to select a connection element and a connecting element made of different materials. Since lead-free soldering compounds cannot compensate mechanical stresses well, it is advantageous to adapt the material of the connection element substrate with regard to the coefficient of thermal expansion and to select the material of the connecting element with regard to good electrical conductivity. Since the connection, in particular the welded connection, of two different materials is weaker than the connection of identical materials, the stability-enhancing effect of the invention is particularly advantageous.

In a preferred embodiment, the connection element and the connecting element are formed from different materials. The difference between the melting temperature of the material of the connection element and the melting temperature of the material of the connecting element is, in an advantageous embodiment, greater than 200° C., preferably greater than 300° C., particularly preferably greater than 400° C. With such connection elements, the advantages according to the invention are especially brought to bear because the connection, in particular the prior art welded connection, is particularly vulnerable in the case of such differences in the melting temperature.

In a preferred embodiment, the connecting element is attached to the connection element by means of a welded connection. This is advantageous since a welded connection can be made quickly and economically and is customary for the connection of a connection element and a connecting element such that established industrial processes need not be changed. As described above, the invention is particularly advantageous with a welded connection of different materials. However, alternatively, other connection techniques can also be selected. Thus, the connection element and the connecting element can be connected, for example, by a clinch connection, a solder connection, a crimp connection, or by means of an electrically conductive adhesive. In these cases as well, the invention acts in a stability-enhancing manner since the vulnerable connection points are less greatly stressed by tensile, shear, or leverage forces.

In an advantageous embodiment, the connecting element is a flexible connection cable. The flexible connection cable is a bendable, electrically conductive cable. The connection cable can be provided with a wire end ferrule or a crimp (metal part crimped around the connection cable) that is connected to the connection element.

The flexible connection cable is, in a preferred embodiment, implemented as a flat-weave ribbon. A flat-weave ribbon is frequently also referred to as a woven wire strand conductor or "woven wire". The connection cable can, alternatively, also be implemented as a wire-strand conductor in the form of a round cable, which is typically provided with a polymeric insulating sheath.

In another advantageous embodiment, the connecting element is a small solid (massive) metal plate. Here, the term "solid metal plate" means a rigid, certainly possibly well formable, but non-bendable metal plate. After forming, the small metal plate remains in the desired shape and position.

The connecting element, whether it is implemented as a flexible connection cable or as a small solid metal plate, is, in a preferred embodiment, implemented with a standardiszed plug connector on the end opposite the connection element, in particular a flat automotive plug with a height of 0.8 mm and a width of 4.8 mm or 6.3 mm or with a height of 1.2 mm and a width of 9.5 mm. Particularly preferably, the width is 6.3 mm, since this corresponds to the flat automotive plug according to DIN 46244 customarily used in this sector. By means of the flat plug, a simple connection of electrical cables to the power supply is ensured. Alternatively, however, the electrical contacting of the connection element can also be done via a solder, weld, crimp, clinch, or clamp connection or a conductive adhesive.

The substrate preferably contains glass, particularly preferably soda lime glass. The substrate is preferably a glass pane, particularly preferably a window pane, in particular a motor vehicle pane. However, the substrate can, in principle, also contain other types of glass, for example, quartz glass or borosilicate glass, or polymers, preferably polyethylene, polypropylene, polycarbonate, polymethylmethacrylate, polystyrene, polybutadiene, polynitriles, polyesters, polyurethane, polyvinylchloride, polyacrylate, polyamide, polyethylene terephthalate, and/or copolymers or mixtures thereof.

The substrate is preferably transparent or translucent. The substrate preferably has a thickness from 0.5 mm to 25 mm, particularly preferably from 1 mm to 10 mm, and most particularly preferably from 1.5 mm to 5 mm.

In a preferred embodiment, the difference between the coefficient of thermal expansion of the substrate and the coefficient of thermal expansion of the connection element is less than $5\times10^{-6}$/° C., preferably less than $3\times10^{-6}$/° C. By means of such a small difference, critical thermal stresses as a result of the soldering procedure can be advantageously avoided and better adhesion is achieved.

The coefficient of thermal expansion of the substrate is preferably from $8\times10^{-6}$/° C. to $9\times10^{-6}$/° C. The substrate preferably contains glass, in particular soda lime glass, which preferably has a coefficient of thermal expansion from $8.3\times10^{-6}$/° C. to $9\times10^{-6}$/° C. in a temperature range from 0° C. to 300° C.

The coefficient of thermal expansion of the connection element is, in an advantageous embodiment, from $4\times10^{-6}$/° C. to $15\times10^{-6}$/° C., preferably from $9\times10^{-6}$/° C. to $13\times10^{-6}$/° C., particularly preferably from $10\times10^{-6}$/° C. to $11.5\times10^{-6}$/° C., most particularly preferably from $10\times10^{-6}$/° C. to $11\times10^{-6}$/° C., and, in particular, from $10\times10^{-6}$/° C. to $10.5\times10^{-6}$/° C. in a temperature range from 0° C. to 300° C.

The connection element preferably contains at least one iron-containing alloy. The connection element particularly preferably contains at least 50 wt.-% to 89.5 wt.-% iron, 0 wt.-% to 50 wt.-% nickel, 0 wt.-% to 20 wt.-% chromium, 0 wt.-% to 20 wt.-% cobalt, 0 wt.-% to 1.5 wt.-% magnesium, 0 wt.-% to 1 wt.-% silicon, 0 wt.-% to 1 wt.-% carbon, 0 wt.-% to 2 wt.-% manganese, 0 wt.-% to 5 wt.-% molybdenum, 0 wt.-% to 1 wt.-% titanium, 0 wt.-% to 1 wt.-% niobium, 0 wt.-% to 1 wt.-% vanadium, 0 wt.-% to 1 wt.-% aluminium, and/or 0 wt.-% to 1 wt.-% tungsten.

The connection element can, for example, contain an iron-nickel-cobalt alloy, such as Kovar (FeCoNi) with a coefficient of thermal expansion of customarily roughly $5\times10^{-6}$/° C. The composition of Kovar is, for example, 54 wt.-% iron, 29 wt.-% nickel, and 17 wt.-% cobalt.

In a particularly preferred embodiment, the connection element contains a chromium-containing steel. Chromium-containing, in particular so-called stainless or corrosion resistant steel is available cost-effectively. Compared to many conventional connection elements, for example, made of copper, connection elements made of chromium-containing steel have, in addition, high rigidity, which results in advantageous stability of the connection element. In addition, chromium-containing steel has, compared to many conventional connection elements, for example, those made of titanium, improved solderability, which results from higher thermal conductivity.

The connection element preferably contains a chromium-containing steel with a chromium content greater than or equal to 10.5 wt.-%. Further alloy components such as molybdenum, manganese, or niobium result in improved corrosion resistance or altered mechanical properties such as tensile strength or cold formability.

The connection element particularly preferably contains at least 66.5 wt.-% to 89.5 wt.-% iron, 10.5 wt.-% to 20 wt.-% chromium, 0 wt.-% to 1 wt.-% carbon, 0 wt.-% to 5 wt.-% nickel, 0 wt.-% to 2 wt.-% manganese, 0 wt.-% to 2.5 wt.-% molybdenum, 0 wt.-% to 2 wt.-% niobium, and 0 wt.-% to 1 wt.-% titanium. The connection element can additionally contain admixtures of other elements, including vanadium, aluminium, and nitrogen.

The connection element most particularly preferably contains at least 73 wt.-% to 89.5 wt.-% iron, 10.5 wt.-% to 20 wt.-% chromium, 0 wt.-% to 0.5 wt.-% carbon, 0 wt.-% to 2.5 wt.-% nickel, 0 wt.-% to 1 wt.-% manganese, 0 wt.-% to 1.5 wt.-% molybdenum, 0 wt.-% to 1 wt.-% niobium, and 0 wt.-% to 1 wt.-% titanium. The connection element can additionally contain admixtures of other elements, including vanadium, aluminium, and nitrogen.

The connection element contains in particular at least 77 wt.-% to 84 wt.-% iron, 16 wt.-% to 18.5 wt.-% chromium, 0 wt.-% to 0.1 wt.-% carbon, 0 wt.-% to 1 wt.-% manganese, 0 wt.-% to 1 wt.-% niobium, 0 wt.-% to 1.5 wt.-% molybdenum, and 0 wt.-% to 1 wt.-% titanium. The connection element can additionally contain admixtures of other elements, including vanadium, aluminium, and nitrogen.

Particularly suitable chromium-containing steels are steels of the material numbers 1.4016, 1.4113, 1.4509, and 1.4510 in accordance with EN 10 088-2.

The connecting element contains, in a preferred embodiment, copper, for example, electrolytic copper. Such a connecting element has advantageously high electrical conductivity. Moreover, such a connecting element is advantageously formable, which can be desirable or necessary for connection to the connection cable. Thus, the connecting element can, for example, be provided with an angle, by means of which the connection direction of the connection cable is adjustable.

The connecting element can also contain a copper-containing alloy, such as brass or bronze alloys, for example, nickel silver or constantan.

The connecting element preferably has electrical resistance from 0.5 μohm·cm to 20 μohm·cm, particularly preferably from 1.0 μohm·cm to 15 μohm·cm, most particularly preferably from 1.5 μohm·cm to 11 μohm·cm.

The connecting element particularly preferably contains 45.0 wt.-% to 100 wt.-% copper, 0 wt.-% to 45 wt.-% zinc, 0 wt.-% to 15 wt.-% tin, 0 wt.-% to 30 wt.-% nickel, and 0 wt.-% to 5 wt.-% silicon.

Particularly suitable as the material of the connecting element is electrolytic copper with the material number CW004A (formerly 2.0065) and CuZn30 with the material number CW505L (formerly 2.0265).

The material thickness of the connection element is preferably from 0.1 mm to 4 mm, particularly preferably from 0.2 mm to 2 mm, most particularly preferably from 0.4 mm to 1 mm, for example, 0.8 mm. The same applies to the connecting element, when it is implemented as a small solid plate. The material thickness is preferably constant, which is particularly advantageous in terms of simple production of the elements.

The dimensions of the connection element can be freely selected by the person skilled in the art depending on the requirements of the individual case. The connection element has, for example, a length and a width from 1 mm to 50 mm. The length of the connection element is preferably from 10 mm to 30 mm, particularly preferably from 20 mm to 25 mm. The width of the connection element is preferably from 1 mm to 30 mm, particularly preferably from 2 mm to 10 mm. Connection elements with these dimensions are particularly easy to handle and are particularly suited for the electrical contacting of conductive structures on panes.

The electrically conductive structure according to the invention preferably has a layer thickness from 5 μm to 40 μm, particularly preferably from 5 μm to 20 μm, most particularly preferably from 8 μm to 15 μm and, in particular, from 10 μm to 12 μm. The electrically conductive structure according to the invention preferably contains silver, particularly preferably silver particles and glass frits.

The soldering compound preferably contains tin and bismuth, indium, zinc, copper, silver, or compositions thereof. The tin content in the solder composition according to the invention is from 3 wt.-% to 99.5 wt.-%, preferably from 10 wt.-% to 95.5 wt.-%, particularly preferably from 15 wt.-% to 60 wt.-%. The content of bismuth, indium, zinc, copper, silver, or compositions thereof is, in the solder composition according to the invention, from 0.5 wt.-% to 97 wt.-%, preferably 10 wt.-% to 67 wt.-%, with the content of bismuth, indium, zinc, copper, or silver possibly being 0 wt.-%. The solder composition can contain nickel, germanium, aluminium, or phosphorous with a content from 0 wt.-% to 5 wt.-%. The solder composition according to the invention most particularly preferably contains Bi40Sn57Ag3, Sn40Bi57Ag3, Bi59Sn40Ag1, Bi57Sn42Ag1, In97Ag3, Sn95.5Ag3.8Cu0.7, Bi67In33, Bi33In50Sn17, Sn77.2In20Ag2.8, Sn95Ag4Cu1, Sn99Cu1, Sn96.5Ag3.5, Sn96.5Ag3Cu0.5, Sn97Ag3, or mixtures thereof.

In an advantageous embodiment, the soldering compound contains bismuth. It has been demonstrated that a bismuth-containing soldering compound results in a particularly good adhesion of the connection element according to the invention on the pane, whereby damage to the pane can be avoided. The content of bismuth in the soldering compound composition is preferably from 0.5 wt.-% to 97 wt.-%, particularly preferably from 10 wt.-% to 67 wt.-%, and most particularly preferably from 33 wt.-% to 67 wt.-%, in particular from 50 wt.-% to 60 wt.-%. The soldering compound preferably contains, in addition to bismuth, tin and silver or tin, silver, and copper. In a particularly preferred embodiment, the soldering compound contains at least 35 wt.-% to 69 wt.-% bismuth, 30 wt.-% to 50 wt.-% tin, 1 wt.-% to 10 wt.-% silver, and 0 wt.-% to 5 wt.-% copper. In a most particularly preferred embodiment, the soldering compound contains at least 49 wt.-% to 60 wt.-% bismuth, 39 wt.-% to 42 wt.-% tin, 1 wt.-% to 4 wt.-% silver, and 0 wt.-% to 3 wt.-% copper.

In another advantageous embodiment, the soldering compound contains from 90 wt.-% to 99.5 wt.-% tin, preferably from 95 wt.-% to 99 wt.-%, particularly preferably from 93 wt.-% to 98 wt.-%. The soldering compound preferably contains, in addition to tin, from 0.5 wt.-% to 5 wt.-% silver and from 0 wt.-% to 5 wt.-% copper.

The layer thickness of the soldering compound is preferably less than or equal to $6.0\times10^{-4}$ m, particularly preferably less than $3.0\times10^{-4}$ m.

The soldering compound flows out with an outflow width of preferably less than 1 mm from the intermediate space between the solder region of the connection element and the electrically conductive structure. In a preferred embodiment, the maximum outflow width is less than 0.5 mm and, in particular, roughly 0 mm. This is particularly advantageous in terms of the reduction of mechanical stresses in the pane, the adhesion of the connection element, and the savings in the amount of solder. The maximum outflow width is defined as the distance between the outer edges of the solder region and the point of the soldering compound crossover, at which the soldering compound drops below a layer thickness of 50 μm. The maximum outflow width is measured on the solidified soldering compound after the soldering operation. A desired maximum outflow width is obtained through a suitable selection of soldering compound volume and vertical distance between the connection element and the electrically conductive structure, which can be determined by simple experiments. The vertical distance between the connection element and the electrically conductive structure can be predefined by an appropriate process tool, for example, a tool with an integrated spacer. The maximum outflow width can even be negative, i.e., pulled back into the intermediate space formed by the solder region of the electrical connection element and an electrically conductive structure. In an advantageous embodiment of the pane according to the invention, the maximum outflow width is pulled back in a concave meniscus in the intermediate space formed between the solder region of the electrical connection element and the electrically conductive structure. A concave meniscus is created, for example, by increasing the vertical distance between the spacer and the conductive structure during the soldering operation, while the solder is still fluid. The advantage resides in the reduction of mechanical stresses in the pane, in particular, in the critical region that is present with a large soldering compound crossover.

In an advantageous improvement, the solder surface of the connection element has spacers. The spacers are preferably implemented in one piece (integrally) with the connection element, for example, by stamping or deep drawing. The spacers preferably have a width from $0.5\times10^{-4}$ m to $10\times10^{-4}$ m and a height from $0.5\times10^{-4}$ m to $5\times10^{-4}$ m, particularly preferably from $1\times10^{-4}$ m to $3\times10^{-4}$ m. By means of the spacers, a homogeneous, uniformly thick, and uniformly fused layer of the soldering compound is obtained. Thus, mechanical stresses between the connection element and the pane can be reduced, and the adhesion of the connection element can be improved. This is particularly advantageous with the use of lead-free soldering compounds that can compensate mechanical stresses less well due to their lower ductility compared to lead-containing soldering compounds.

In an advantageous improvement, at least one contact bump, which serves for contacting the connection element with the soldering tool during the soldering operation, can be arranged on the surface of the connection element facing away from the substrate. The contact bump is preferably curved convexly at least in the region of contacting with the soldering tool. The contact bump preferably has a height of 0.1 mm to 2 mm, particularly preferably of 0.2 mm to 1 mm. The length and width of the contact bump is preferably between 0.1 and 5 mm, most particularly preferably between 0.4 mm and 3 mm. The contact bumps are preferably implemented in one piece with the connection element, for example, by stamping or deep drawing. For the soldering, electrodes whose contact side is flat can be used. The electrode surface is brought into contact with the contact bump. The electrode surface is arranged parallel to the surface of the substrate. The contact region between the electrode surface and the contact bump forms the solder joint. The position of the solder joint is determined by the point on the convex surface of the contact bump that has the greatest vertical distance from the surface of the substrate. The position of the solder joint is independent of the position of the solder electrode on the connection element. This is particularly advantageous in terms of reproducible, uniform heat distribution during the soldering operation. The heat distribution during the soldering operation is determined by the position, the size, the arrangement, and the geometry of the contact bump.

The connection element and/or the connecting element can have a coating (wetting layer), which contains, for example, nickel, copper, zinc, tin, silver, gold, or alloys or layers thereof, preferably silver or tin. By this means, improved wetting of the connection element with the soldering compound and improved adhesion of the connection element are obtained. Moreover, by means of such a coating, the electrical conductivity of the connection element and of the connecting element can be increased.

In an advantageous embodiment, the connection element is provided with an adhesion-promoting layer, preferably made of nickel and/or copper, and, additionally, provided with a silver-containing layer. The connection element according to the invention is most particularly preferably coated with 0.1 μm to 0.3 μm nickel and, thereupon, optionally, 0.1 μm to 10 μm copper and, thereupon, 3 μm to 20 μm silver.

The shape of the electrical connection element can form one or a plurality of solder depots in the intermediate space between the connection element and the electrically conductive structure. The solder depots and wetting properties of the solder on the connection element prevent the outflow of the soldering compound from the intermediate space. Solder depots can be rectangular, rounded, or polygonal in design.

The invention further includes a method for producing a pane according to the invention, wherein (a) the bridge-shaped electrical connection element is connected to the connecting element, (b) the soldering compound is applied on the contact surfaces of the soldering feet of the connection element, (c) the connection element with the soldering compound is arranged on a region of an electrically conductive structure, which is applied on a region of a substrate, and (d) the connection element is connected to the electrically conductive structure under application of energy.

The connecting of the connection element and the connecting element is preferably done by welding, but can also be done by clinching, crimping, soldering, gluing, or clamping.

The connecting element is connected to the surface of the bridge region facing the substrate or to the surface facing away from the substrate. In the latter case, the connecting element must be routed around the bridge region before it is connected to an electrical cable. If the connecting element is implemented as a solid, this is done before process step (c). The connecting element can already be preshaped before process step (a) or formed after process step (a) or (b). If the connecting element is implemented as a flexible cable, the routing around the bridge region can be done even after the soldering in step (d).

The soldering compound is preferably attached to the connection element as a platelet or a flattened drop with a fixed layer thickness, volume, shape, and arrangement. The layer thickness of the soldering compound platelet is preferably less than or equal to 0.6 mm. The shape of the soldering compound platelet is preferably governed by the shape of the contact surface of the connection element and is, for example, rectangular, circular, oval, or rectangular with rounded corners, or rectangular with semicircles positioned on two opposite sides.

The introduction of energy during the electrical connecting of an electrical connection element and an electrically conductive structure occurs preferably by means of punch soldering, thermode soldering, piston soldering, laser soldering, hot air soldering, induction soldering, resistance soldering, and/or with ultrasound.

The electrically conductive structure can be applied on the substrate by methods known per se, in particular, by a screen printing method.

The invention further includes the use of a pane according to the invention in buildings or in means of transportation for travel on land, in the air, or on water, in particular in rail vehicles or motor vehicles, preferably as a windshield, rear window, side window, and/or roof panel, in particular as a heatable pane or as a pane with an antenna function.

Figure 2:
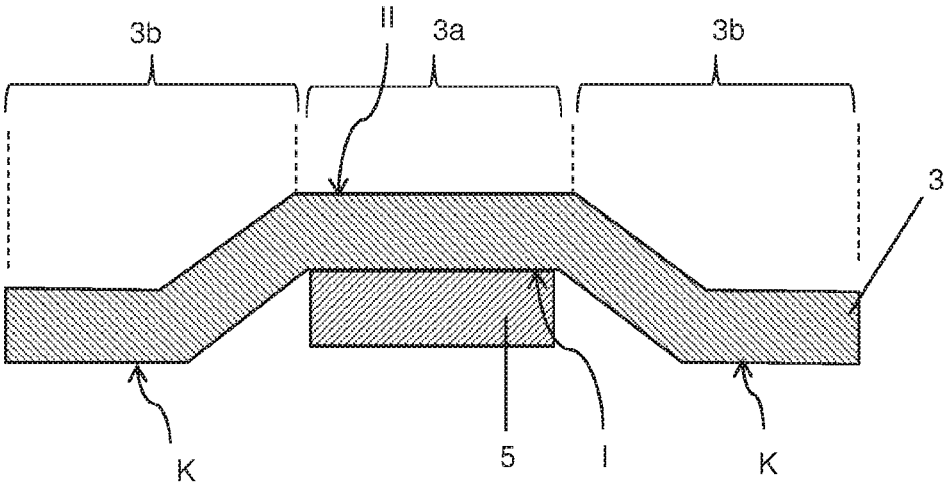
Figure 3:
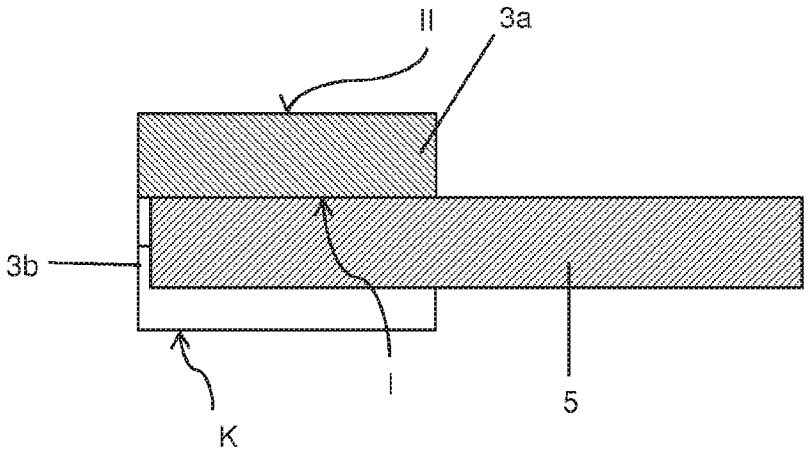
Figure 4:
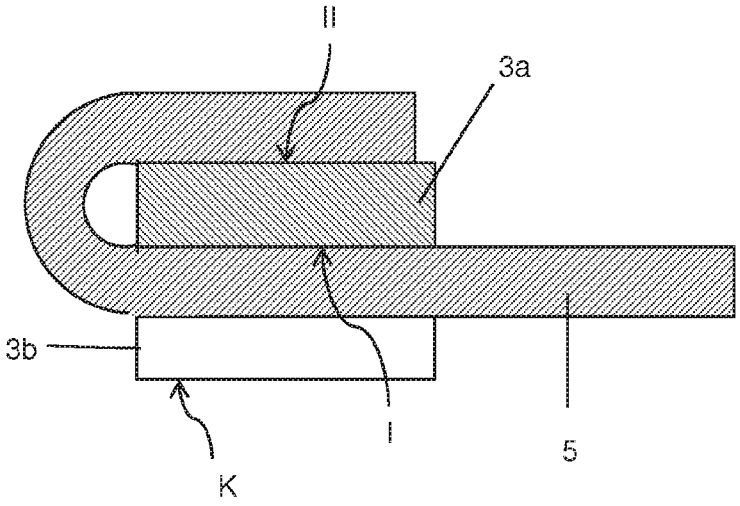
Figure 5:
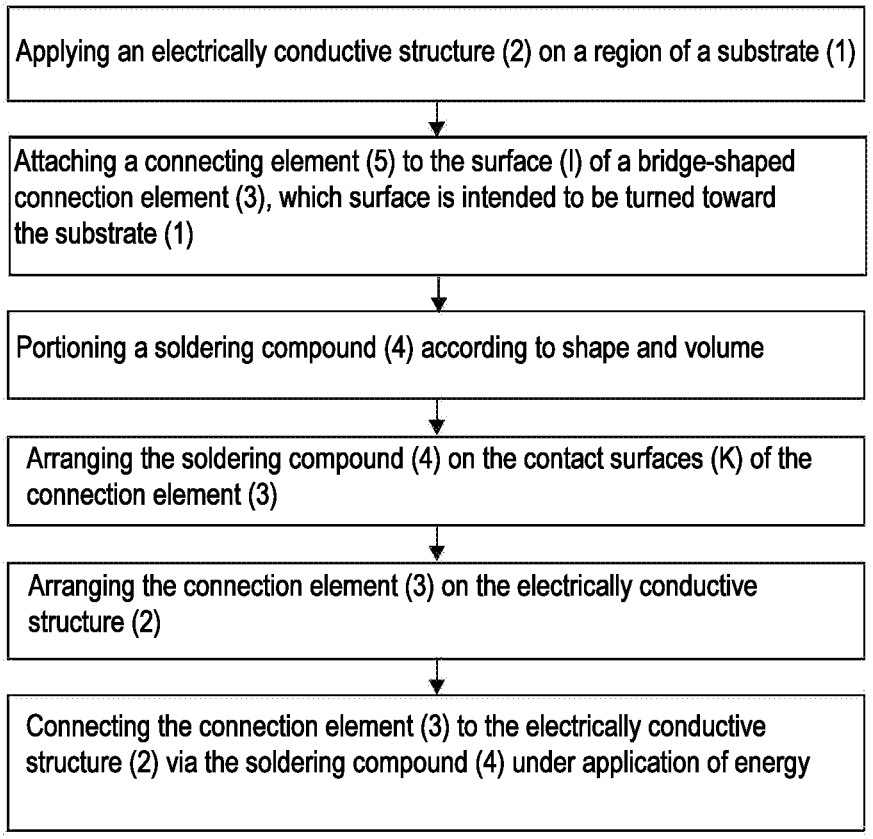
Figure 6:
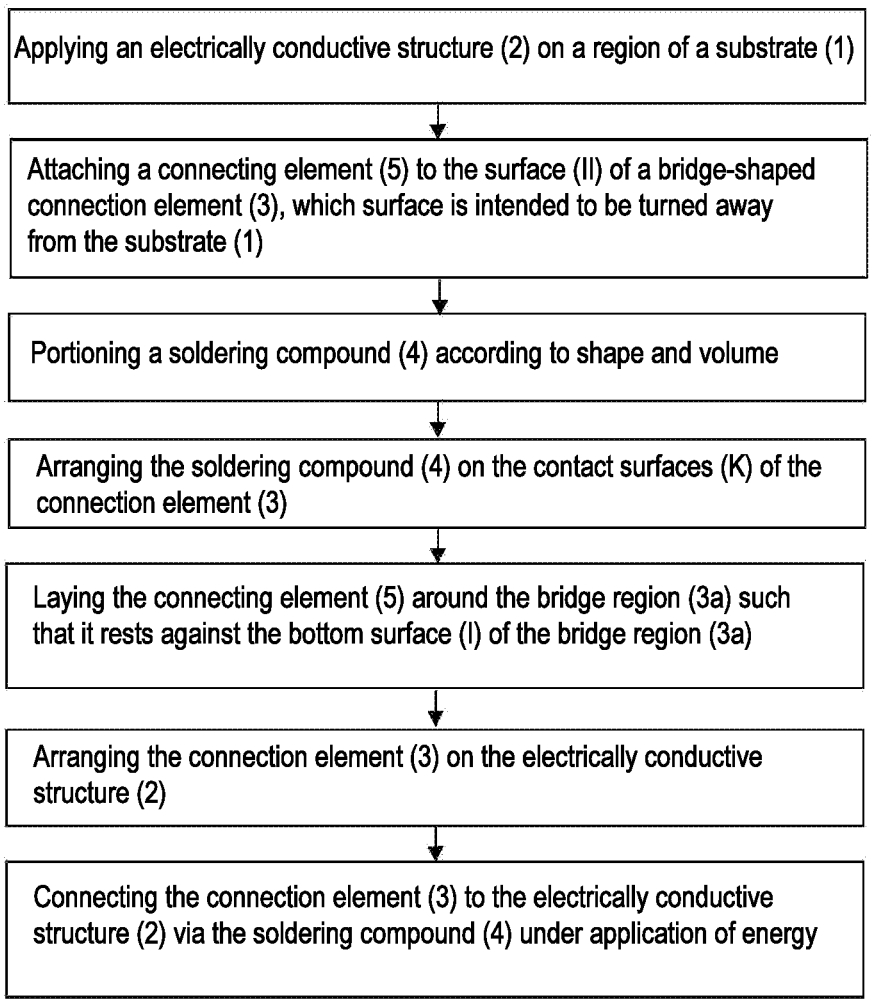

The invention is explained in detail with reference to drawings and exemplary embodiments. The drawings are schematic representations and not true to scale. The drawings in no way restrict the invention. They depict:

FIG. 1 an exploded view of an embodiment of the pane according to the invention with an electrical connection element, FIG. 2 a cross-section through the connection element with a connecting element of FIG. 1, FIG. 3 another cross-section through the connection element with a connecting element of FIG. 1, FIG. 4 a cross-section through another embodiment of the connection element according to the invention with a connecting element, FIG. 5 a flowchart of an embodiment of the production method according to the invention, and FIG. 6 a flowchart of another embodiment of the production method according to the invention.

FIG. 1 depicts a pane according to the invention (exploded view); FIG. 2 a cross-section along the longitudinal axis of the connection element according to the invention. FIG. 3 depicts another cross-section perpendicular thereto along the longitudinal axis of the connecting element through the bridge region. The pane is, for example, a rear window of a passenger car and comprises a substrate 1, which is a 3-mm-thick thermally prestressed single pane safety glass made of soda lime glass. The substrate 1 has, for example, a width of 150 cm and a height of 80 cm. An electrically conductive structure 2 in the form of a heating conductor structure is printed on the substrate 1. The electrically conductive structure 2 contains silver particles and glass frits. In the edge region of the pane, the electrically conductive structure 2 is widened to a width of roughly 10 mm and forms a contact surface for the electrical connection element 3. The connection element 3 serves for the electrical contacting of the electrically conductive structure 2 to an external power supply via a connection cable (not shown). The electrical contacting is concealed for an observer outside the vehicle by a masking screenprint 6 between the electrically conductive structure 2 and the substrate 1.

The connection element 3 is implemented in the shape of a bridge and has a bridge region 3*a* and two oppositely arranged soldering feet 3*b*. Each soldering foot 3*b* has, on its underside, a flat surface K, wherein the surfaces K of the two soldering feet 3*b* lie in one plane and form the contact surface of the connection element 3 for soldering. The contact surfaces K are durably connected electrically and mechanically to the electrically conductive structure 2 via a soldering compound 4. The soldering compound 4 is lead-free, contains 57 wt.-% bismuth, 40 wt.-% tin, and 3 wt.-% silver, and has a thickness of 250 μm.

A connecting element 5 is attached to the connection element 3. The connecting element 5 is depicted here schematically as a solid platelet, but it can also be implemented as a flexible connection cable, for example, as a flat-weave ribbon.

The connection element 3 and the connecting element 5 have in each case a material thickness of 0.8 mm. Thus, advantageously, a standard-compliant motor vehicle plug connector can be formed from the connecting element 5. If one wishes to use a smaller material thickness for the connecting element 5, a material thickness whose even-numbered multiple yields 0.8 mm is recommended, i.e., for example, 0.4 mm or 0.2 mm, such that the thickness of the standard-compliant plug connector can be obtained by folding. The connection element 3 has, for example, a length of 24 mm and a width of 4 mm. The connecting element 5 has, for example, a width of 6.3 mm and a length of 27 mm.

In order to avoid critical mechanical stresses as a result of temperature changes, the coefficient of thermal expansion of the connection element 3 is coordinated with the coefficient of thermal expansion of the substrate 1. The connection element 3 is made, for example, of chromium-containing steel of the material number 1.4509 in accordance with EN 10 088-2 (ThyssenKrupp Nirosta® 4509) with a coefficient of thermal expansion of $10.5\times10^{-6}/°$ C. in the temperature range from 20° C. to 300° C. Motor vehicle window panes are typically made of soda lime glass, which has a coefficient of thermal expansion of roughly $9\times10^{-6}/°$ C. Due to the small difference in the coefficients of thermal expansion, critical thermal stresses can be avoided.

The connecting element 5 should have high electrical conductivity and good formability, which is advantageous for contacting with a connection cable. Consequently, the connecting element 5 is made of copper of the material number CW004A (Cu-ETP) with an electrical resistance of 1.8 μohm·cm. The connecting element 5 can, additionally, be tinned for protection against oxidation or silvered to improve electrical conductivity.

The connection element 3 and the connecting element 5 are welded to one another. However, due to the different materials, the welded connection is weakened. Steel of the material number 1.4509 has a melting temperature of approx. 1505° C.; copper, in contrast, approx. 1083° C. The large difference in melting points results in problems during welding. Thus, the connection element 3 must be heated to a very high temperature in order to fuse. In the process, the connecting element 5 can be damaged. The connecting element 5 as a melted and annealed copper part then forms a weak point in the arrangement.

If, as has been the practice until now, the connecting element were arranged on the surface II (top) of the connection element facing away from the substrate 1, the weakened connection could easily result in the detachment ("peeling") of the connecting element since, in particular, tensile forces on the connecting element would act directly on this connection. The connecting element 5 could detach from the connection element 3. This effect can already occur at lower tensile forces than acceptable for the motor vehicle industry.

In contrast to the prior art configurations, the connecting element 5 is attached (welded) according to the invention not to the top II but to the surface I (bottom) of the bridge region 3*a* facing the substrate 1. Tensile forces, which typically have an upward force component (viewed from the substrate 1 outward), are, as it were, diverted around the bridge region 3*a* and can, consequently, not act directly on the weakened connection. The connection can, consequently, withstand significantly higher tensile forces.

FIG. 4 depicts a cross-section along the longitudinal axis of the connecting element 5 of another embodiment of the invention. The connecting element 5 is welded onto the surface II of the bridge region 3*a* facing away from the substrate. From there, the connecting element 5 runs around a first side edge of the bridge region 3*a* and along surface I facing the substrate, against which the connecting element 5 rests with its full surface. The connecting element 5 extends beyond the side edge of the bridge region 3*a* opposite the first side edge. An electrical connection cable for connection to the vehicle's electrical system can be attached there on the end of the connecting element 5. This embodiment also results in the fact that tensile and leverage forces act on the surface I, which increases the stability of the connection.

Due to the routing of the connecting element 5 around the bridge region 3*a*, this embodiment is suitable in particular when the connecting element 5 is implemented as a flexible cable. However, even solid connecting elements 5 can be shaped correspondingly.

FIG. 5 and FIG. 6 depict in each case an embodiment of the method according to the invention for producing a pane according to the invention with a connection element 3 according to the invention. The order of the process steps must be interpreted as an exemplary embodiment and does not restrict the invention. Thus, it is, for example, also possible to connect the connecting element 5 to the bridge region 3*a* only after arranging the soldering compound 4 on the contact surfaces K.

Example 1

A series of bridge-shaped connection elements 3 were welded and fixed according to the invention to a connecting element 5. Subsequently, an upwardly directed tensile force of 200N was exerted on the connecting element 5. The same test was performed with connection elements in which the connecting element was attached according to the prior art to the top II of the connection element 3. The materials were selected in both cases according to the exemplary embodiments in FIGS. 1-3.

In the case of the prior art arrangement, the welded connection broke in 85% of the cases. Breakage was reduced to 0% by the arrangement according to the invention.

Example 2

A tensile test was performed on prior art connection elements and on connection elements 3 according to the invention. An upward directed tensile force, which was steadily increased until breakage of the connection between the connection element 3 and the connecting element 5, was exerted on the connecting elements. The values measured for the maximum tensile force are summarised in Table 1. The measurement values a and b refer to connection elements 3 from different manufacturers.

TABLE 1

| Configuration of the connection element 3 with a connecting element 5 | Observed tensile forces at breakage of the connection |
|---|---|
| Prior art: connecting element 5 welded on the top II of the bridge region 3a | a: 131 N-152 N<br>b: 161 N-186 N |
| According to the invention: connecting element 5 welded on the bottom I of the bridge region 3a | a: 433 N-448 N<br>b: 386 N-399 N |
| According to the invention: connecting element 5 welded on the top II of the bridge region 3a and routed around the bridge region 3a, resting against bottom I | a: 316 N-364 N<br>b: 408 N-462 N |

From the measurement results, it is clearly discernible that the invention results in an increase in the load-bearing capacity by a factor of 2 to 3. This was unexpected and surprising for the person skilled in the art. Which of the configurations according to the invention delivers greater load-bearing capacity depends on the concrete configuration of the connection element.

LIST OF REFERENCE CHARACTERS (1) substrate
(2) electrically conductive structure
(3) bridge-shaped electrical connection element
(3*a*) bridge region of 3
(3*b*) soldering foot of 3
(4) soldering compound
(5) connecting element
(6) masking print
(I) bottom of 3*a*, facing the substrate 1
(II) top of 3*a*, facing away from the substrate 1
(K) contact surface of 3*b*

The invention claimed is:

1. A pane with at least one electrical connection element, comprising:
- a substrate;
- an electrically conductive structure on a region of the substrate;
- a bridge-shaped electrical connection element, including a bridge region and two or more soldering feet, which are connected via a soldering compound to a region of the electrically conductive structure; and
- an electrical connecting element attached to the bridge-shaped electrical connection element,
- wherein the electrical connecting element
  - is attached to a first surface of the bridge region facing the substrate, or
  - is attached to a second surface of the bridge region facing away from the substrate, routing around the bridge region, and resting against the first surface of the bridge region,
- wherein a difference between a melting temperature of the bridge-shaped connection element and a melting temperature of the electrical connecting element is greater than 200° C., and
- wherein the electrical connecting element is attached to the bridge-shaped electrical connection element by a welded connection.

2. The pane according to claim 1, wherein the soldering compound is a lead-free soldering compound.

3. The pane according to claim 1, wherein the difference between the melting temperature of the bridge-shaped electrical connection element and the melting temperature of the electrical connecting element is greater than 300° C.

4. The pane according to claim 1, wherein the electrical connecting element is attached to the bridge-shaped electrical connection element by a welded connection.

5. The pane according to claim 1, wherein the electrical connecting element is a solid metal plate.

6. The pane according to claim 1, wherein the electrical connecting element is a flexible connection cable.

7. The pane according to claim 6, wherein the flexible connection cable is a flat-weave ribbon or a round cable.

8. The pane according to claim 1, wherein the bridge-shaped electrical connection element contains an at least one iron-containing alloy.

9. The pane according to claim 8, wherein the bridge-shaped electrical connection element is formed from chromium-containing steel.

10. The pane according to claim claim 9, wherein the bridge-shaped electrical connection element is formed from 66.5 wt.-% to 89.5 wt.-% iron, 10.5 wt.-% to 20 wt.-% chromium, 0 wt.-% to 1 wt.-% carbon, 0 wt.-% to 5 wt.-% nickel, 0 wt.-% to 2 wt.-% manganese, 0 wt.-% to 2.5 wt.-% molybdenum, 0 wt.-% to 2 wt.-% niobium, and 0 wt.-% to 1 wt.-% titanium.

11. The pane according to claim 1, wherein the electrical connecting element is formed from copper or a copper-containing alloy.

12. The pane according to claim 1, wherein a thickness of the bridge-shaped electrical connection element is from 0.1 mm to 4 mm.

13. The pane according to claim 1, wherein a difference between a coefficient of thermal expansion of the substrate and a coefficient of thermal expansion of the bridge-shaped electrical connection element is less than $5\times10^{-6}/°$ C.

14. The pane according to claim 1, wherein the substrate is formed from glass.

15. The pane according to claim 14, wherein the the glass is soda lime glass.

16. The pane according to claim 1, wherein the electrically conductive structure is formed from silver and has a layer thickness of 5 μm to 40 μm.

17. A method of using a pane with at least one electrical connection element, comprising:
- providing a pane according to claim 1; and
- using the pane in buildings or in means of transportation for travel on land, in the air, or on water.

18. The pane according to claim 1, wherein the difference between the melting temperature of the bridge-shaped electrical connection element and the melting temperature of the electrical connecting element is greater than 400° C.

19. The pane according to claim 1, wherein a thickness of the bridge-shaped electrical connection element is from 0.2 mm to 2 mm.

20. The pane according to claim 1, wherein a thickness of the bridge-shaped electrical connection element is from 0.4 mm to 1 mm.

21. The pane according to claim 1, wherein a difference between a coefficient of thermal expansion of the substrate and a coefficient of thermal expansion of the bridge-shaped electrical connection element is less than $3\times10^{-6}/°$ C.

22. The pane according to claim 1, wherein the electrically conductive structure comprises silver particles and glass frits and has a layer thickness of 5 μm to 40 μm.

23. A method for producing a pane with at least one electrical connection element, the pane including a substrate;

an electrically conductive structure on a region of the substrate;

a bridge-shaped electrical connection element, including a bridge region and two or more soldering feet, which are connected via a soldering compound to a region of the electrically conductive structure; and an electrical connecting element attached to the bridge-shaped electrical connection element, wherein the electrical connecting element is attached to a first surface of the bridge region facing the substrate, or is attached to a second surface of the bridge region facing away from the substrate, routing around the bridge region, and resting against the first surface of the bridge region, wherein a difference between a melting temperature of the bridge-shaped connection element and a melting temperature of the electrical connecting element is greater than 200° C., and wherein the electrical connecting element is attached to the bridge-shaped electrical connection element by a welded connection, the method comprising:

(a) connecting the bridge-shaped electrical connection element to the electrical connecting element;

(b) applying the soldering compound on contact surfaces of the soldering feet of the bridge-shaped electrical connection element;

(c) arranging the bridge-shaped electrical connection element with the soldering compound on the region of the electrically conductive structure, which is applied on the region of a substrate; and (d) connecting the bridge-shaped electrical connection element to the electrically conductive structure by application of energy.

24. The method of using a pane according to claim 17, wherein the pane is used in rail vehicles or motor vehicles.

25. The method of using a pane according to claim 17, wherein the pane is used in a windshield, a rear window, a side window, or a roof panel.

26. The method of using a pane according to claim 17, wherein the pane is used in a heatable pane or a pane with an antenna function.

* * * * *